US012031351B2

(12) United States Patent
McQueen et al.

(10) Patent No.: US 12,031,351 B2
(45) Date of Patent: Jul. 9, 2024

(54) SYSTEMS AND METHODS OF EFFECTING LATERAL MOVEMENT OF A CLEANING DEVICE ALONG A WATERLINE OF A VESSEL OR OTHERWISE WITHIN THE VESSEL

(71) Applicant: ZODIAC POOL CARE EUROPE, Bron (FR)

(72) Inventors: E. Keith McQueen, Vista, CA (US); Simon Duffaut, Castelginest (FR); Benoit Florimond, Bron (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 648 days.

(21) Appl. No.: 17/185,298

(22) Filed: Feb. 25, 2021

(65) Prior Publication Data

US 2021/0277679 A1 Sep. 9, 2021

Related U.S. Application Data

(60) Provisional application No. 62/987,146, filed on Mar. 9, 2020.

(51) Int. Cl.
*E04H 4/16* (2006.01)

(52) U.S. Cl.
CPC ..... *E04H 4/1654* (2013.01)

(58) Field of Classification Search
CPC ..... E04H 4/1654
See application file for complete search history.

(56) References Cited

U.S. PATENT DOCUMENTS 6,299,699 B1 * 10/2001 Porat ..... E04H 4/1654 15/49.1
2017/0342733 A1 * 11/2017 Korenfeld ..... E04H 4/1654
2018/0327026 A1 * 11/2018 Marciano ..... F16H 57/025

FOREIGN PATENT DOCUMENTS

| | | |
|---|---|---|
| EP | 0220131 | 4/1987 |
| EP | 2824256 | 1/2015 |
| EP | 3093413 | 11/2016 |
| EP | 3438380 | 2/2019 |
| WO | 9851395 | 11/1998 |
| WO | 2005045162 | 5/2005 |

OTHER PUBLICATIONS

International Application No. PCT/US2021/019648, International Search Report and Written Opinion dated Jul. 20, 2021, 16 pages.
International Application No. PCT/US2021/019648, Invitation to Pay Additional Fees &, Where Applicable Protest Fee dated May 26, 2021, 5 pages.
International Application No. PCT/US2021/019648, International Preliminary Report on Patentability dated Sep. 22, 2022, 11 pages.

* cited by examiner

*Primary Examiner* — Brian P Sweeney
(74) *Attorney, Agent, or Firm* — Kilpatrick Townsend & Stockton LLP

(57) ABSTRACT

An automatic swimming pool cleaner having a body can be caused to travel laterally along a surface of a swimming pool by varying a characteristic of operation of at least one motive element. For example, a first motive element (such as a brush and/or wheel on one side of the body) can be driven at a different speed and/or in a different direction than a second motive (such as a brush and/or wheel on the opposite side of the body) element to cause the automatic pool cleaner to move laterally along the surface of the swimming pool.

16 Claims, 3 Drawing Sheets

SYSTEMS AND METHODS OF EFFECTING LATERAL MOVEMENT OF A CLEANING DEVICE ALONG A WATERLINE OF A VESSEL OR OTHERWISE WITHIN THE VESSEL

CROSS-REFERENCE TO RELATED APPLICATION

This application claims the benefit of and priority to U.S. Provisional Patent Application Ser. No. 62/987,146, filed Mar. 9, 2020, the entire contents of which are hereby incorporated herein by this reference.

FIELD OF THE INVENTION

This invention relates to systems and methods of cleaning water-containing vessels such as swimming pools and spas and more particularly, although not necessarily exclusively, to causing cleaning apparatuses to move autonomously within such vessels laterally along portions of walls at and adjacent the waterlines, allowing efficient scrubbing and other cleaning of the walls of the vessels in the areas of their waterlines. The lateral-movement techniques also may be employed on floors or steps of, or otherwise within, the vessels.

BACKGROUND OF THE INVENTION

European Patent Application Publication No. 3093413 of Maytronics (the "EP '413 Application") discloses a pool cleaning robot having waterline cleaning capabilities. FIG. 33 of the EP '413 Application illustrates such a robot "performing a sideward movement" at a waterline of a pool. See EP '413 Application, p. 4, 11. 11-14. The EP '413 Application describes methods of "tilting" the robot to change its direction of movement, see id. at p. 5, 11. 46-50, employing an "imbalance induction unit" to move either a fluid-output nozzle or a diaphragm. See id. at p. 6, 11. 17-34. European Patent Application Publication No. 3438380 of Maytronics (the "EP '380 Application") details another pool cleaning robot in which water may be directed to first and second grills having movable panes. See EP '380 Application, p. 2, 11. 26-37.

Directional control of automatic swimming pool cleaners ("APCs") using water jets does not always produce optimal results. As one of many examples, when an APC is adjacent a waterline of a pool, exhaust water may be jetted into air or otherwise exit the pool, producing a different directional thrust result than were the water from the APC to be exhausted into the main body of water of the pool. Different methods of controlling APCs thus are desirable.

DESCRIPTION OF THE INVENTION

The present invention does not rely on changing direction of exhausted water to control direction of an autonomous pool cleaner (APC). Instead, adjustments to rotation speeds and rotation directions of traction motors of the APC may be utilized to effect such control. Appropriate adjustments may allow an APC to move laterally ("crab walk") along a vertical pool wall at the waterline of a swimming pool or other body of water. Such movements admit efficient scrubbing of the wall at the waterline to remove debris therefrom.

Figure 1:
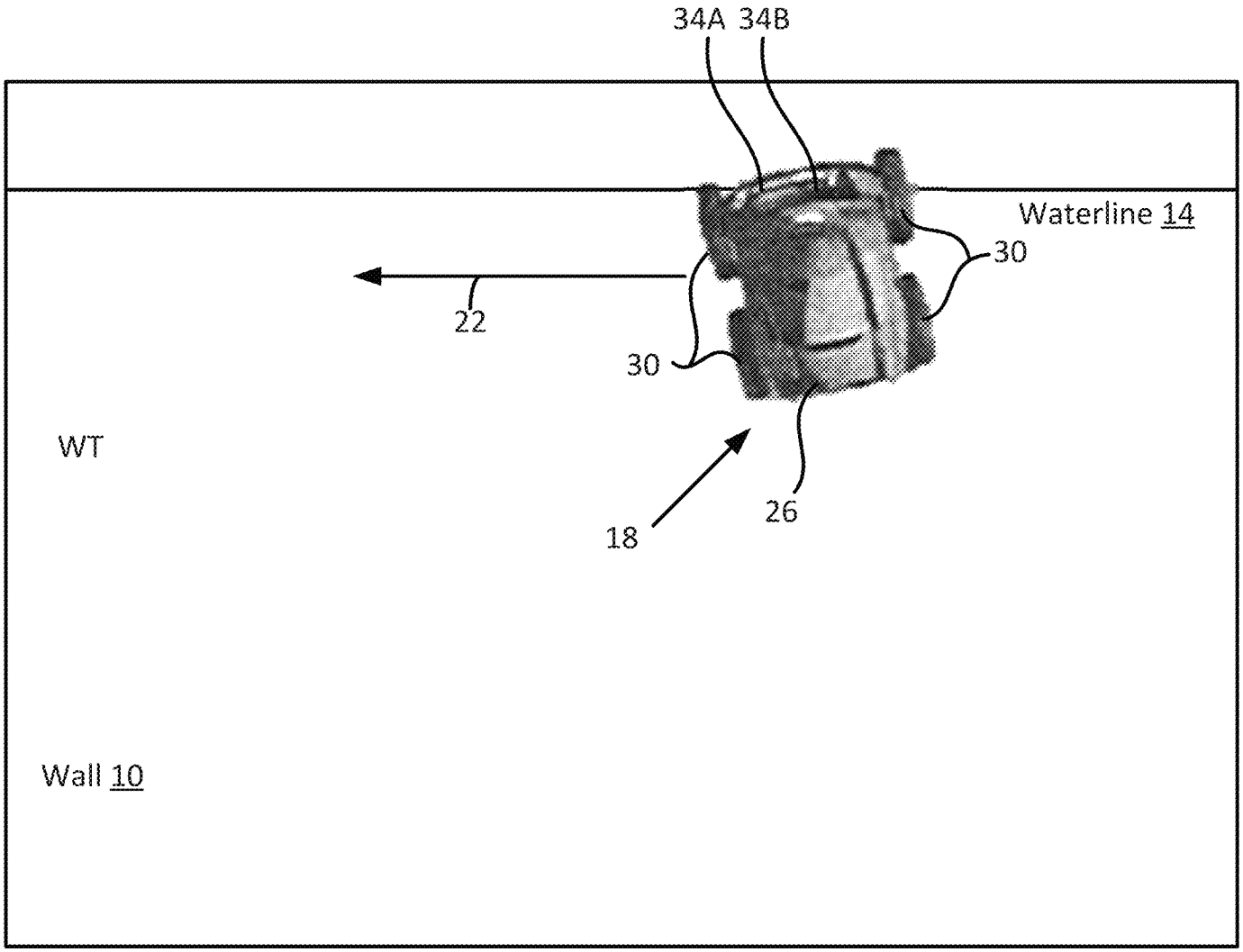
FIG. 1 illustrates exemplary aspects of lateral movement of an automatic pool cleaner (APC).

FIG. 1 illustrates this concept of lateral movement of an APC. Schematically shown in FIG. 1 is upstanding (i.e. generally vertical) wall 10 of a swimming pool. Also depicted is waterline 14, identifying the height of wall 10 to which the pool is filled with water WT. Debris often is present in areas of wall 10 at and adjacent waterline 14 and advantageously is subject to cleaning. APC 18 may move predominantly laterally along wall 10 at waterline 14, promoting efficient cleaning in this region. FIG. 1 illustrates APC 18 moving to the left of the drawing (in the direction of arrow 22), but alternatively, APC 18 could crab walk to the right of the drawing, opposite arrow 22.

In some embodiments of the invention, APC 18 may be a robotic cleaner using electrical power for movement and cleaning. Accordingly, APC 18 may include body 26 having an on-board pump and at least one motor (and preferably at least two motors). An on-board or remote controller may be employed, and APC 18 further may include wheels 30, tracks, or other motive elements as well as brushes 34A and 34B. Brushes 34A and 34B advantageously are adjacent one another and are configured to rotate about a common axis parallel to axes about which wheels 30 rotate, with such rotation being used both to scrub (clean) the surface with which they are in contact and to facilitate movement of the APC 18. Brushes 34A and 34B, therefore, may also be described as motive elements for the cleaner, with their rotation axes being transverse (perpendicular) to a nominal forward or rearward direction of travel of the cleaner.

Each of brushes 34A and 34B is driven, directly or indirectly, by the at least one motor. Further, each brush 34A or 34B may be driven independently of the other. Thus, at any given time, a characteristic (such as, speed and/or direction) of one brush 34A or 34B may differ from the corresponding value of that characteristic of the other brush 34B or 34A. (Similarly if desired, speed and direction of wheels 30 on a left side of body 26 may be driven independently of speed and direction of the wheels 30 on a right side of body 26.)

More specifically, in one example, the brush 34A (and/or the wheels 20 on the left side of the body 26) can be driven at a first speed and in a first direction (e.g., a "forward" direction) while the brush 34B (and/or the wheels 20 on the right side of the body 26) is driven at a second speed and in a second direction (e.g., a "backward" direction). Each of the second speed and the second direction may be different from the first speed and the first direction, causing the APC 18 to move laterally along the waterline 14.

In some instances, the controller can output a first command to drive the motor associated with brush 34A (and/or other motive element on one side of the body 26) at the first speed and in the first direction. The controller can additionally output a second command to drive the motor associated with brush 34B (and/or other motive element on the other side of the body 26) at the second speed and in the second direction. As a result, the APC 18 can move laterally along the waterline 14.

One of many examples of this concept can involve one motor of APC 18 associated with brush 34A being operated at 70% of maximum output in one direction (called a "forward" direction), while the other motor associated with brush 34B is operated at 30% of maximum output in an opposite direction (called a "backward" direction). The result of these operations is that APC 18 moves predominantly laterally in the direction of arrow 22. As noted in the text, output of the pump of APC 18 additionally may be adjusted to assist in controlling the movement of APC 18.

Persons skilled in the appropriate art will recognize that the 70% and 30% values are merely examples of a wide variety of outputs that may be provided. Indeed, any outputs from 0-100% of maximum may be available to drive brushes 34A and 34B. Accordingly, APC 18 may be controlled to move laterally at different speeds along wall 10.

Figure 2:
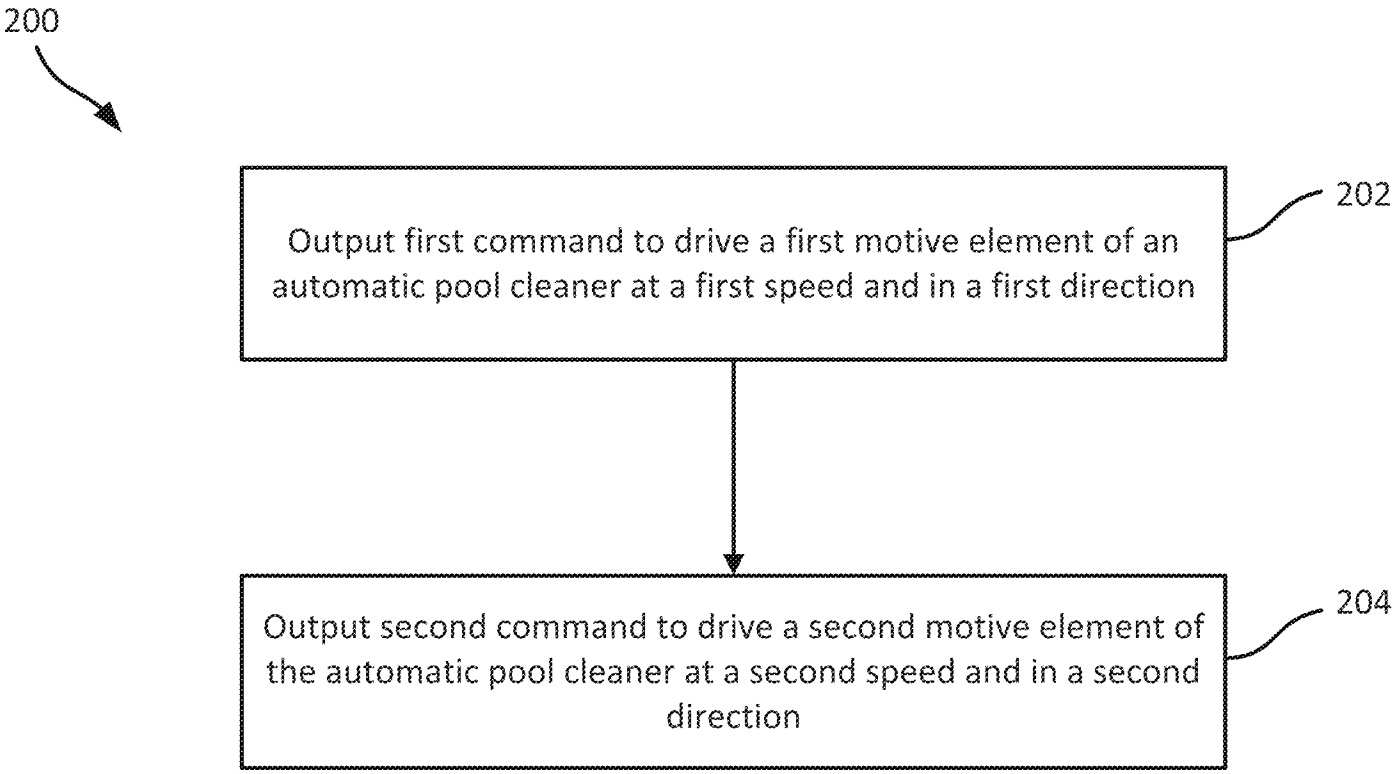
FIG. 2 illustrates an exemplary process for effecting lateral movement of an APC.

FIG. 2 illustrates an exemplary process 200 for effecting lateral movement of an APC, such as APC 18 in FIG. 1. At block 202, a first command to drive a first motive element of the APC at a first speed and in a first direction can be output. For example, the first speed can be a high speed (e.g., greater than 50% maximum output) and the first direction can be a forward direction. The first motive element may be a brush with a rotation axis that is transverse to a nominal forward or backward direction of travel of the APC.

At block 204, a second command to drive a second motive element of the APC at a second speed and in a second direction can be output. The second speed and the second direction may be different from the first speed and the first direction, so as to cause the APC to move laterally. The second motive element can also be a brush that shares a common axis of rotation with the first motive element. As an example, the second speed can be a low speed (e.g., less than 50% maximum output) and the second direction can be a backward direction. As a result, the APC can move in a leftward direction. In some embodiments, the first direction is opposite the second direction.

Figure 3:
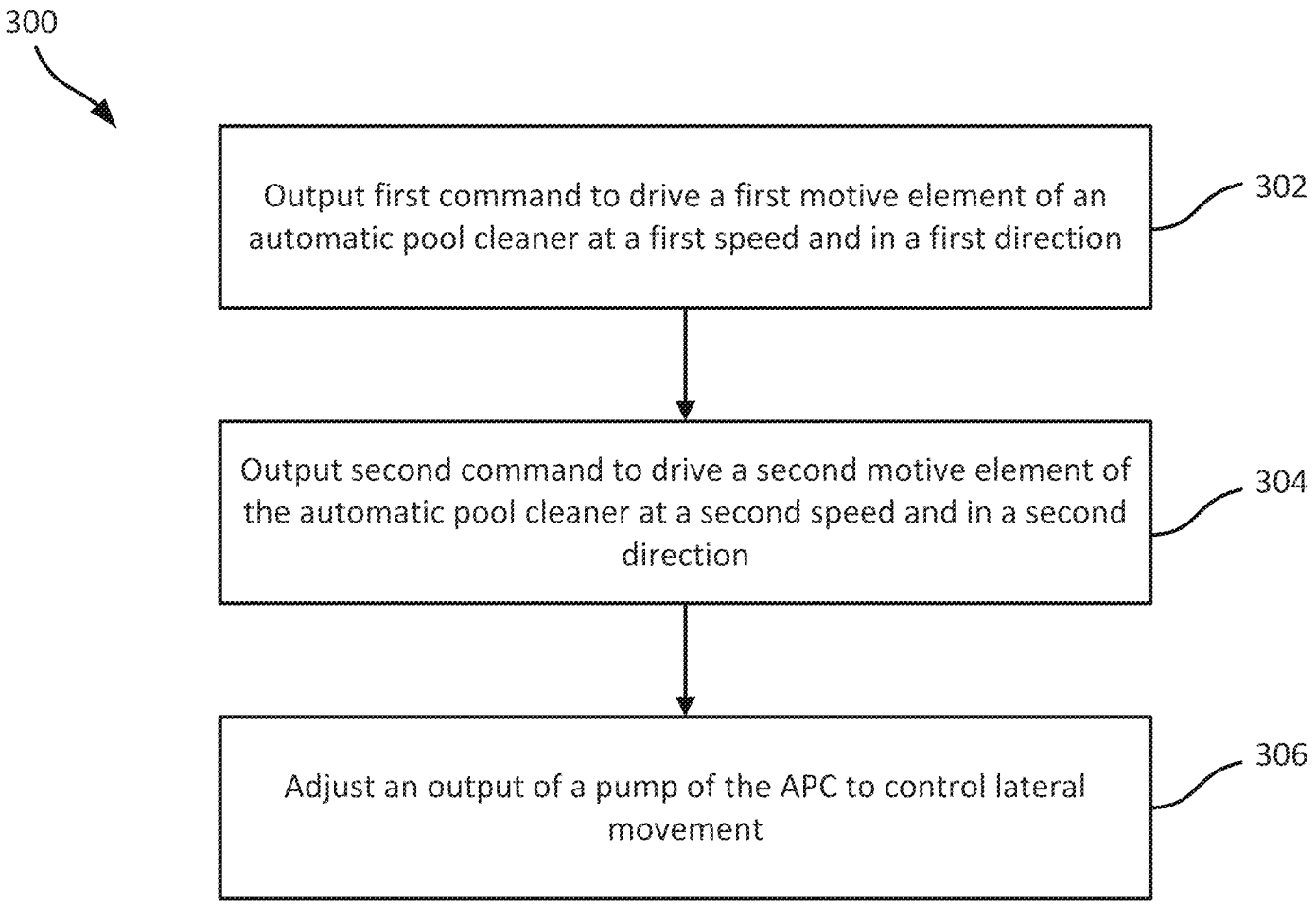
FIG. 3 illustrates another exemplary process for effecting lateral movement of an APC.

FIG. 3 illustrates another exemplary process 300 for effecting lateral movement of an APC, such as APC 18 in FIG. 1. Blocks 302 and 304 can be similar to blocks 202 and 204 in FIG. 2. At block 306, an output of a pump of the APC can be adjusted to control the lateral movement of the APC. For example, adjusting the output of the pump may result in a faster or slower lateral movement of the APC.

The inventive concept is not limited to effecting lateral movement along a generally vertical aspect of a pool. As well, such movement at times may be advantageous when a cleaner is in contact with a generally horizontal surface (e.g., a pool bottom) or some other angled surface or wall or step. Indeed, this lateral movement could help APC 18 avoid obstacles protruding from a surface on which it travels or facilitate, e.g., spot cleaning of debris discovered near a nominal forward or rearward path of travel of the cleaner. Periodic or sporadic lateral movement of the cleaner also could substitute for "back-up" devices commonly used with certain conventional cleaners, which devices function to re-set travel paths to reduce likelihood that a cleaner will remain stuck in a corner of a pool, for example.

Persons skilled in the art will recognize that the unbalanced traction speeds discussed herein may be achieved in any suitable manner. In some versions of APC 18, more than one drive motor may be employed, with the motors operating at different speeds to drive brushes, wheels, or tracks at different velocities. In other versions of APC 18, a single motor may be geared differently as connected to different brushes, tracks, or wheels so as to produce different traction speeds. Other techniques recognizable by skilled persons alternatively or additionally may be utilized.

Illustrative Aspects

As used below, any reference to a series of aspects (e.g., "Aspects A-D") or non-enumerated group of aspects (e.g., "any previous or subsequent aspect") is to be understood as a reference to each of those aspects disjunctively (e.g., "Aspects A-D" is to be understood as "Aspects A, B, C, or D").

Aspect A is a method of causing an automatic swimming pool cleaner having a body to travel laterally along a surface of a swimming pool by varying a characteristic of operation of at least one motive element.

Aspect B is the method of any previous or subsequent aspect, wherein varying a characteristic of operation of a motive element comprises driving a first motive element at a different speed or in a different direction than a second motive element.

Aspect C is the method of any previous or subsequent aspect, wherein each of the first and second motive elements comprises a brush and the first and second motive elements are configured to rotate about a common axis.

Aspect D is the method of any previous or subsequent aspect, further comprising driving the first motive element independently of the second motive element.

Aspect E is the method of any previous or subsequent aspect, further comprising adjusting an output of a pump of the automatic pool cleaner to assist lateral movement of the automatic pool cleaner.

Aspect F is a method comprising causing automatic pool cleaner having a body to travel laterally along a surface of a swimming pool by outputting a first command to drive a first motive element of the automatic pool cleaner at a first speed and in a first direction and outputting a second command to drive a second motive element of the automatic pool cleaner at a second speed and in a second direction that are different from the first speed and the first direction.

Aspect G is the method of any previous or subsequent aspect, wherein the first motive element and the second motive element comprise brushes.

Aspect H is the method of any previous or subsequent aspect, wherein the first motive element and the second motive element are configured to rotate about a common axis.

Aspect I is the method of any previous or subsequent aspect, wherein the common axis is transverse to the first direction or the second direction.

Aspect J is the method of any previous or subsequent aspect, wherein driving the first motive element and the second motive element comprises operating at least one motor.

Aspect K is the method of any previous or subsequent aspect, further comprising adjusting an output of a pump of the automatic pool cleaner to control lateral movement of the automatic pool cleaner along the surface of the swimming pool.

Aspect L is an automatic swimming pool cleaner comprising a body, a controller, at least one drive mechanism, and first and second motive elements, and in which the at least one drive mechanism is configured to drive the first motive element at a different speed than the second motive element upon command of the controller in order to effect lateral movement of the body within a swimming pool.

Aspect M is the automatic swimming pool cleaner of any previous or subsequent aspect, wherein the first and second motive elements are configured to rotate about a common axis that is parallel to the lateral movement.

Aspect N is the automatic swimming pool cleaner of any previous or subsequent aspect, wherein the common axis of the first and second motive elements is configured to be transverse to a nominal forward or rearward direction of travel of the body.

Aspect O is the automatic swimming pool cleaner of any previous or subsequent aspect, further comprising a pump configured to further effect lateral movement of the body within the swimming pool.

Aspect P is the automatic swimming pool cleaner of any previous or subsequent aspect, wherein each the first and second motive elements comprises a brush.

These example aspects are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

The entire contents of the EP '413 Application and the EP '380 Application are incorporated herein by this reference. The invention may be useful as part of other cleaners including, for example, the dual-brush Vortex 4WD range of robotic cleaners commercially sold by the applicant. Concepts of the invention could be utilized in connection with other vehicles too.

The foregoing is provided for purposes of illustrating, explaining, and describing embodiments of the present invention. Modifications and adaptations to these embodiments will be apparent to those skilled in the art and may be made without departing from the scope or spirit of the invention. Additionally, the word "pool" and phrase "swimming pool" as used herein may include vessels such as spas and hot tubs within their definitions.

What is claimed is:

1. A method of causing an automatic swimming pool cleaner having a body, a first motive element, and a second motive element to travel laterally along a surface of a swimming pool while the body is oriented vertically relative to a waterline of the swimming pool and while contacting the surface of the swimming pool by varying a characteristic of operation of the first motive element relative to the second motive element.

2. The method of claim 1, wherein varying a characteristic of operation of the first motive element comprises driving the first motive element at a different speed or in a different direction than the second motive element.

3. The method of claim 2, wherein each of the first and second motive elements comprises a brush and the first and second motive elements rotate about a common axis while the automatic pool cleaner travels laterally along the surface of the swimming pool.

4. The method of claim 2, further comprising driving the first motive element independently of the second motive element.

5. The method of claim 1, further comprising adjusting an output of a pump of the automatic swimming pool cleaner to assist lateral movement of the automatic swimming pool cleaner.

6. A method comprising:

causing an automatic pool cleaner having a body to travel laterally along a surface of a swimming pool while the body is oriented vertically relative to a waterline of the swimming pool by:

outputting a first command to drive a first motive element of the automatic pool cleaner at a first speed and in a first direction; and outputting a second command to drive a second motive element of the automatic pool cleaner at a second speed and in a second direction that are different from the first speed and the first direction.

7. The method of claim 6, wherein the first motive element and the second motive element comprise brushes.

8. The method of claim 6, wherein the first motive element and the second motive element rotate about a common axis when the automatic pool cleaner travels laterally along the surface of the swimming pool.

9. The method of claim 8, wherein the common axis is transverse to the first direction or the second direction.

10. The method of claim 6, wherein driving the first motive element and the second motive element comprises operating at least one motor.

11. The method of claim 6, further comprising adjusting an output of a pump of the automatic pool cleaner to control lateral movement of the automatic pool cleaner along the surface of the swimming pool.

12. An automatic swimming pool cleaner comprising:

a body;

a controller;

at least one drive mechanism; and first and second motive elements, wherein the at least one drive mechanism is configured to drive the first motive element at a different speed than the second motive element upon command of the controller in order to effect lateral movement of the body within a swimming pool while the body is oriented vertically relative to a waterline of the swimming pool or spa.

13. The automatic swimming pool cleaner of claim 12, wherein the first and second motive elements are configured to rotate about a common axis that is parallel to the lateral movement.

14. The automatic swimming pool cleaner of claim 13, wherein the common axis of the first and second motive elements is configured to be transverse to a nominal forward or rearward direction of travel of the body.

15. The automatic swimming pool cleaner of claim 12, further comprising a pump configured to further effect lateral movement of the body within the swimming pool.

16. The automatic swimming pool cleaner of claim 12, wherein each the first and second motive elements comprises a brush.

* * * * *